US011731174B2

(12) United States Patent
Consentino et al.

(10) Patent No.: US 11,731,174 B2
(45) Date of Patent: Aug. 22, 2023

(54) METHOD OF IMPROVING A CORROSION PROTECTION OF A HOLLOW SHAFT

(71) Applicant: Mahle International GmbH, Stuttgart (DE)

(72) Inventors: Rodrigo Consentino, Fellbach (DE); Michael Dohms, Bergisch-Gladbach (DE); Antonio Menonna, Ditzingen (DE); Ralf Rieger, Steinheim a.d. Murr (DE)

(73) Assignee: Mahle International GmbH

( * ) Notice: Subject to any disclaimer, the term of this patent is extended or adjusted under 35 U.S.C. 154(b) by 328 days.

(21) Appl. No.: 16/752,318

(22) Filed: Jan. 24, 2020

(65) Prior Publication Data

US 2020/0238344 A1 Jul. 30, 2020

(30) Foreign Application Priority Data

Jan. 25, 2019 (DE) ..... 102019200951.4

(51) Int. Cl.

| | |
|---|---|
| ***B08B 9/032*** | (2006.01) |
| ***B08B 5/00*** | (2006.01) |
| ***F01L 1/047*** | (2006.01) |
| ***B08B 5/02*** | (2006.01) |

(52) U.S. Cl.

CPC ..... *B08B 9/0328* (2013.01); *B08B 5/02* (2013.01); *F01L 1/047* (2013.01)

(58) Field of Classification Search

None

See application file for complete search history.

(56) References Cited

U.S. PATENT DOCUMENTS 2,445,645 A * 7/1948 Stephens ..... B05C 7/08 118/408
2,792,807 A * 5/1957 Cummings ..... B05C 7/08 118/72
3,376,151 A * 4/1968 Yoshihiro ..... B05D 7/222 118/308
3,768,145 A * 10/1973 Ostrowski ..... C23C 2/38 29/458
3,825,443 A * 7/1974 Reilly ..... B08B 9/055 134/24

(Continued)

FOREIGN PATENT DOCUMENTS

CN 101920239 A 12/2010
CN 102513253 A 6/2012

(Continued)

OTHER PUBLICATIONS

DE3926507 English translation, accessed on Dec. 2021. (Year: 1991).*

(Continued)

*Primary Examiner* — Eric W Golightly
*Assistant Examiner* — Arlyn I Rivera-Cordero
(74) *Attorney, Agent, or Firm* — Fishman Stewart PLLC

(57) ABSTRACT

A method for improving a corrosion protection of a hollow shaft may include introducing a lance into the hollow shaft, and cleaning and expelling a liquid from an inside of the hollow shaft via spraying a gas from the lance. The method may also include applying a corrosion protection medium onto an inner lateral surface of the hollow shaft at least in certain regions, and closing off the hollow shaft.

19 Claims, 2 Drawing Sheets

(56) References Cited

U.S. PATENT DOCUMENTS

| | | | | | |
|---|---|---|---|---|---|
| 4,216,738 | A * | 8/1980 | Muta | F16L 55/1645 118/72 |
| 2002/0054957 | A1 * | 5/2002 | Johnsen | C08L 2666/54 427/230 |
| 2017/0252783 | A1 * | 9/2017 | Thomas | B65H 75/38 |

FOREIGN PATENT DOCUMENTS

| | | | | | |
|---|---|---|---|---|---|
| CN | 103170445 | A | | 6/2013 | |
| DE | 3926507 | A1 | | 2/1991 | |
| DE | 102015105680 | | * | 10/2016 | B05C 7/08 |
| KR | 101646153 | | * | 8/2016 | B05D 7/24 |

OTHER PUBLICATIONS

KR101646153 English translation, accessed on Jun. 2022. (Year: 2016).*

DE102015105680 English translation, accessed on Jun. 2022. (Year: 2016).*

English abstract for DE-3926507, 1 page, Date: Feb. 14, 1991.

Ceducci Holdinggesellschaft UG, Jan. 19, 2013, 3 pages, Receipt date: Mar. 21, 2022.

X-technik, Additive Fertigung, www.additive-fertigung.at, Jun. 2, 2016, 76 pages, Receipt date; Mar. 21, 2022.

Chinese Office Action dated May 7, 2022 for copending Chinese App. No. 201911390133.3 (with English translation).

Chinese Search Report dated Apr. 28, 2022 for copending Chinese App. No. 201911390133.3.

"Practical manual of building water supply and drainage, heating, ventilation and air conditioning", Du Jian, p. 100, China Construction Industry Press, Dec. 31, 2004 (referred to as E1) (with English translation).

* cited by examiner

METHOD OF IMPROVING A CORROSION PROTECTION OF A HOLLOW SHAFT

CROSS-REFERENCE TO RELATED APPLICATIONS

This application claims priority to German Patent Application No. DE 10 2019 200 951.4, filed on Jan. 25, 2019, the contents of which are hereby incorporated by reference in its entirety.

TECHNICAL FIELD

The present invention relates to a method for improving a corrosion protection of a hollow shaft. In addition, the invention relates to a hollow shaft treated by means of such a method.

BACKGROUND

In internal combustion engines, camshafts for controlling inlet and exhaust valves are employed which are frequently produced as hollow shafts in order to achieve either a reduction in weight and an increase in strength or in order to be able to accommodate components located inside, such as for example an internal shaft in the case of an adjustable camshaft. In particular in the case of hollow shafts without components located inside, these are usually sealed on the longitudinal end side by means of a plug or a cover in order to prevent dirt or moisture from entering. However, closing the hollow shaft causes water, for example condensate that is present within the hollow shaft to be trapped in the hollow shaft, which can result in corrosion of the hollow shaft in the long term.

SUMMARY

The present invention therefore deals with the problem of stating a method for the corrosion protection of a hollow shaft by means of which a corrosion risk of such a hollow shaft can be at least reduced.

According to the invention, this problem is solved through the subject of the independent claim(s). Advantageous embodiments are subject of the dependent claim(s).

The present invention is based on the general idea of reducing the corrosion risk of a hollow shaft in that the same, prior to a sealing, is freed of water that is present in the hollow shaft or moisture that is present in the hollow shaft and a corrosion inhibitor is additionally applied prior to the closing. With the method according to the invention, a lance is introduced into the hollow shaft and a gas, in particular air, sprayed out by means of the said lance, by means of which the hollow shaft is cleaned from the inside, i.e. in particular liquid or moisture is expelled. By spraying-out the gas, in particular the air, by means of the lance the hollow shaft is thus dried from the inside. Following this, a corrosion protection medium is applied, for example likewise by means of this lance, to an interior lateral surface of the hollow shaft at least in certain regions, wherein it is obviously conceivable that the spraying-out of gas, in particular air, and the application of the corrosion protection medium can also be accomplished by way of two different lances. By way of the preceding spraying-out of gas it is possible to subsequently apply the corrosion protection medium to the dried inner lateral surface and thereby seal the same. Following this, the hollow shaft is closed off which can be effected for example by introducing a plug or putting on a cover. With the method according to the invention it is thus possible to achieve a particularly high degree of drying in a hollow space of the hollow shaft and at the same time coat the inner lateral surface of the hollow shaft by means of a corrosion protection medium, as a result of which the corrosion risk can be significantly lowered.

In an advantageous further development of the solution according to the invention, an oil, a grease, a wax, a dewatering medium with a corrosion protection medium and/or a drying agent is applied to the inner lateral surface of the hollow shaft as corrosion protection medium. Oil, grease and/or wax bring about a sealing of the surface of the inner lateral surface as a result of which even moisture subsequently entering the hollow shaft cannot get to the inner lateral surface of the hollow shaft to trigger a corrosion process there. By applying a drying agent it is possible to subsequently, in particular during the operation, absorb and bind entering moisture, as a result of which the corrosion risk can likewise be lowered. Oils, greases or wax can additionally contain corrosion-inhibiting additives as a result of which the corrosion protection can be increased even further. Such corrosion-inhibiting additives can obviously also be added to the drying agent.

In an advantageous further development of the solution according to the invention, an inert gas is sprayed out via the lance for cleaning the hollow shaft, which has the major advantage that the same is highly inert and therefore involved in only few chemical reactions. Such an inert gas can be for example argon, nitrogen, xenon, neon, helium or krypton. In particular nitrogen offers the major advantage that the same is cost-effective and additionally temperature-resistant.

Practically, the lance, during the spraying-out of the gas, in particular of the air, and during the application of the corrosion protection medium, is moved with a distance d between 0.5 mm and 3 mm, in particular with a distance d between 1 mm and 2 mm to the inner lateral surface, in particular coaxially to the hollow shaft. Obviously, a superimposed rotational movement of the lance is likewise conceivable. By way of the selected distance it is possible to build up the pressure that is required for completely expelling the moisture or liquid and thereby ensure that the liquid or the moisture is preferably expelled completely from the hollow shaft.

In a further advantageous embodiment, a camshaft is used as hollow shaft. In particular in hollow camshafts there is the risk that the same, with trapped moisture or trapped liquid, corrode in the long term and because of this suffer damage since these are exposed to a continuous high load during the operation. Thus, the method according to the invention is suitable in a particular manner as corrosion protection method for camshafts.

When for example a camshaft is used as hollow shaft it is conceivable to introduce, for example drill, ventilation holes into these in places which are not covered by cams or bearings or other elements later on. By way of this, an air exchange can be made possible as a result of which any moisture still present in the hollow shaft can be expelled again or during the operation of the camshaft in an internal combustion engine there is the possibility of introducing oil and thus corrosion protection medium into the hollow shaft, for example by way of a surrounding oil mist.

Practically, the lance sprays out gas, in particular air during a forward movement and thereby expels the liquid or moisture present in the hollow shaft while during a reverse movement it applies the corrosion protection medium on the inner lateral surface of the hollow shaft. In this case, both the gas, in particular the air, cleaning the hollow space in the hollow shaft and also the corrosion protection medium is output by way of the lance. This makes possible a fully automated method and thus rapid cycle times and low unit costs.

Alternatively to this it is purely theoretically also possible that the lance, during a forward movement, i.e. on entering the hollow shaft, sprays out gas, in particular air, and thereby expels liquid that is present in the hollow shaft and, in entry direction behind that, applies the corrosion protection medium on the inner lateral surface of the hollow shaft by way of nozzles that are arranged axially offset. This would have the major advantage that both the expelling of the liquid and also the applying of the corrosion protection medium can be performed in one working direction. Purely theoretically it is even conceivable in this case that during the exit movement, i.e. during the reverse movement of the lance, a layer of corrosion protection medium is again applied as a result of which the corrosion protection can be improved.

Purely theoretically it is obviously also conceivable that two different lances are provided, of which one is designed for spraying-out the gas and the other one for applying the corrosion protection medium.

In a further advantageous embodiment of the solution according to the invention, the camshaft or generally the hollow shaft is vertically arranged during the spraying-out of the gas, in particular of the air, by means of the lance, as a result of which an expulsion of the liquid present in the hollow shaft supported by the force of gravity can take place. Obviously, an oblique arrangement of the hollow shaft is also conceivable. During the application of the corrosion protection medium, the hollow shaft can likewise be arranged vertically or obliquely, or horizontally, wherein in particular the latter position offers the advantage that the corrosion protection medium can only conditionally exit the hollow shaft based on the force of gravity.

Further important features and advantages of the invention are obtained from the subclaims, from the drawings and from the associated figure description by way of the drawings.

It is to be understood that the features mentioned above and still to be explained in the following cannot only be used in the respective combination stated but also in other combinations or by themselves without leaving the scope of the present invention.

Preferred exemplary embodiments of the invention are shown in the drawings and are explained in more detail in the following description, wherein same reference numbers relate to same or similar or functionally same components.

BRIEF DESCRIPTION OF THE DRAWINGS

There it shows, in each case schematically.

DETAILED DESCRIPTION

Figure 1:
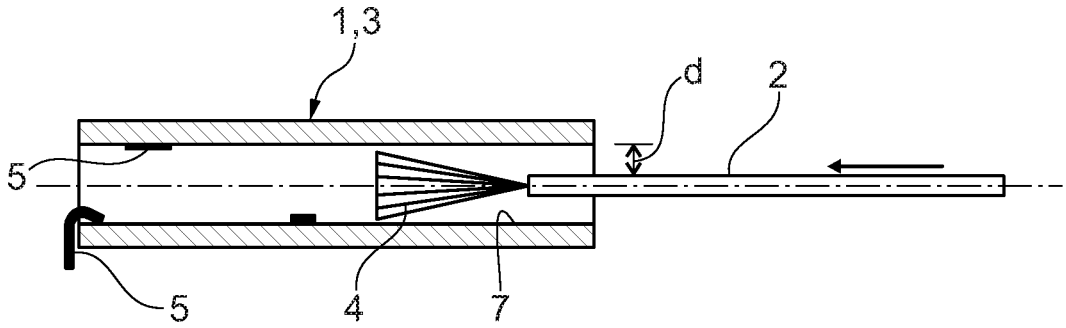
FIGS. 1 to 4 each show different method steps for carrying out the method according to the invention for the corrosion protection of an initially open hollow shaft.

According to FIGS. 1 to 4, different method steps for carrying out the method according to the invention for producing a corrosion protection of a hollow shaft 1 are shown, wherein in the first method step, which is shown in FIG. 1, initially a lance 2 is introduced into the hollow shaft 1, which can be formed for example as a camshaft 3. On introducing the lance 2 into the hollow shaft 1, a gas 4, in particular air, is sprayed out by means of the lance 2, by means of which the hollow shaft 1 is cleaned from the inside, in particular liquid 5, for example water, or moisture present there is expelled. To this end, the hollow shaft 1 can be arranged horizontally, obliquely or even vertically, wherein according to FIGS. 1 to 4 exclusively a horizontal position of the hollow shaft 1 is shown.

Figure 2:
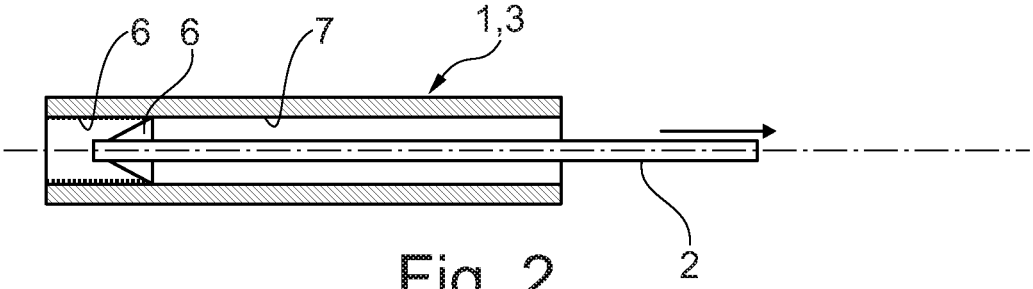
Figure 3:
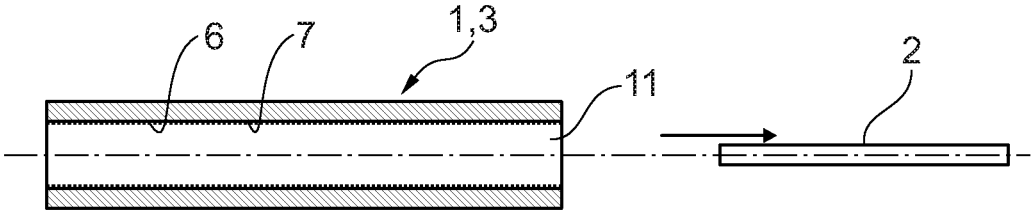
Figure 4:
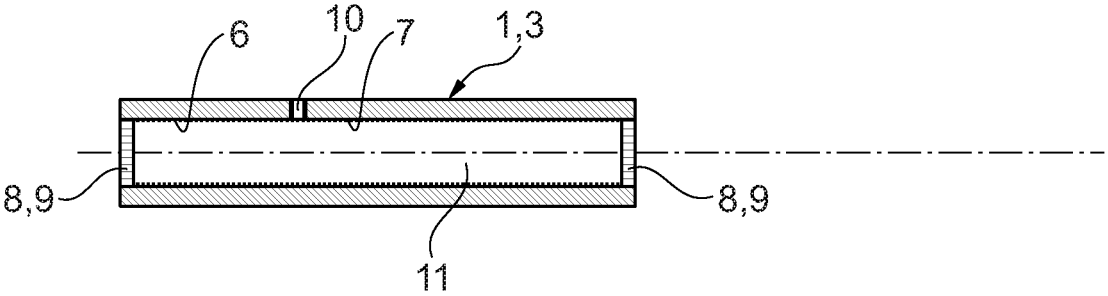
Figure 5:
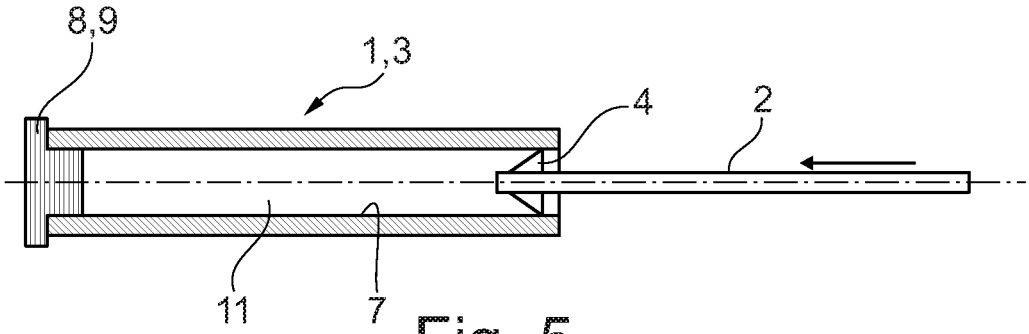
FIGS. 5 to 8 each show different method steps for carrying out the method according to the invention for the corrosion protection with a hollow shaft closed off on one side.

In a following method step shown according to FIG. 2, a corrosion protection medium 6 is applied to an inner lateral surface 7 of the hollow shaft 1 by means of the lance 2 at least in certain regions, upon which in the method step according to FIG. 3, the lance 2 is moved out of the hollow shaft 1. Finally, the hollow shaft 1, in the fourth method step, shown according to FIG. 4, is closed, for example by means of a plug 9 or a cover 8.

By way of the method according to the invention, a significant lowering of a corrosion risk is achievable, since under certain conditions liquid 5 or moisture still present in the hollow shaft 1 can be preferentially removed entirely prior to applying the corrosion protection medium 6.

In FIGS. 1 to 3, always only a single lance 2 is shown, by means of which during a forward movement (see FIG. 1), i.e. an entry movement of the lance 2 into the hollow shaft 1, gas 4, in particular air, is sprayed out and thereby the liquid 5 present in the hollow shaft 1 is expelled, while with the same lances 2 during a reverse movement, i.e. an exit movement of the lance 2 from the hollow shaft 1 (see FIG. 2) the corrosion protection medium 6 is applied to the inner lateral surface 7 of the hollow shaft 1. Purely theoretically it is also conceivable however that for this purpose two different lances 2 are provided, of which one is designed for spraying out the gas 4, in particular the air, and the other for applying or spraying out the corrosion protection medium 6. Purely theoretically it is also conceivable that the lance 2 during a forward movement sprays out gas 4 and because of this removes the liquid 5 present in the hollow shaft 1 and simultaneously, in entry direction behind that, applies the corrosion protection medium 6 by way of suitable nozzles to the inner lateral surface 7 of the hollow shaft 1. This would have the major advantage that applying the corrosion protection medium 6 by means of the lance 2 is possible both during the entry movement and also during the exit movement and because of this can apply a larger quantity of corrosion protection medium 6.

Viewing FIG. 1 further it is noticeable that the lance 2 during the spraying-out of the gas 4, in particular of the air, and according to FIG. 2 also during the applying of the corrosion protection medium 6, is moved with a distance d of 0.5 mm to 3 mm, in particular with a distance d of 1 mm to 2 mm, to the inner lateral surface 7 of the hollow shaft 1, as a result of which in particular during the spraying-out of the gas 4 the pressure required for the preferentially complete expulsion of the liquid 5 can be built up. There, beside a purely coaxial, i.e. linear movement of the lance 2, a rotating of the same is also conceivable.

Viewing FIG. 4 it is evident on the hollow shaft 1 shown there that the same comprises a passage opening 10 (ventilation hole), via which a ventilation of an interior 11 of the hollow shaft 1, in particular of the camshaft 3, is possible during the operation. By way of such a passage opening 10, moisture or liquid can be expelled from the interior 11 of the hollow shaft 1 and under certain conditions oil, i.e. a corrosion protection medium 6, be introduced into the interior 11 during the operation of the hollow shaft 1. Such a passage opening 10 is usually arranged in a place that is not covered by a bearing or a cam with installed camshaft.

According to FIGS. 5 to 8, different method steps for carrying out the method according to the invention for producing a corrosion protection of a hollow shaft 1 are likewise shown, but which is already closed on one side by a plug 9 or a cover 8 at the beginning. In the first method step shown in FIG. 5, a lance 2 is initially introduced into the hollow shaft 1, which can be formed for example as camshaft 3, and in the process a gas 4, in particular air, sprayed out by means of the lance 2, by means of which the hollow shaft 1 is cleaned from the inside at least in certain regions, in particular liquid 5, for example water or moisture present there, is expelled. To this end, the hollow shaft 1 can be arranged horizontally, obliquely or even vertically, wherein according to FIGS. 5 to 8 exclusively a horizontal position of the hollow shaft 1 is shown. The entry movement can even take place with a gas jet directed against the entry movement, wherein it is also conceivable that the lance 2 is initially moved in up to just before the cover 8 or the plug 9 without pressure and the hollow shaft 1 blown out only during a pulling-out which is not shown.

Figure 6:
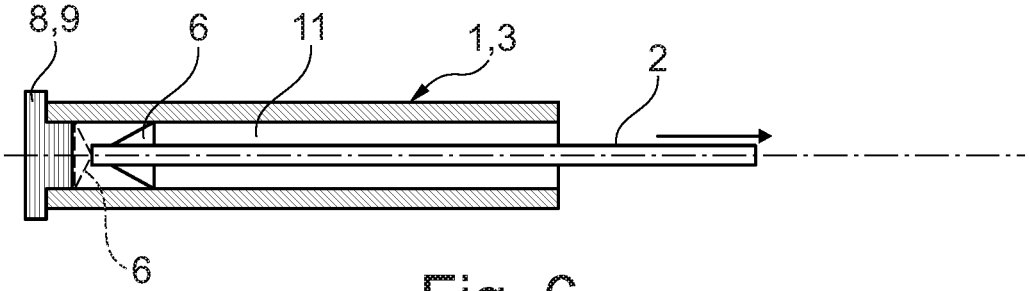
Figure 7:
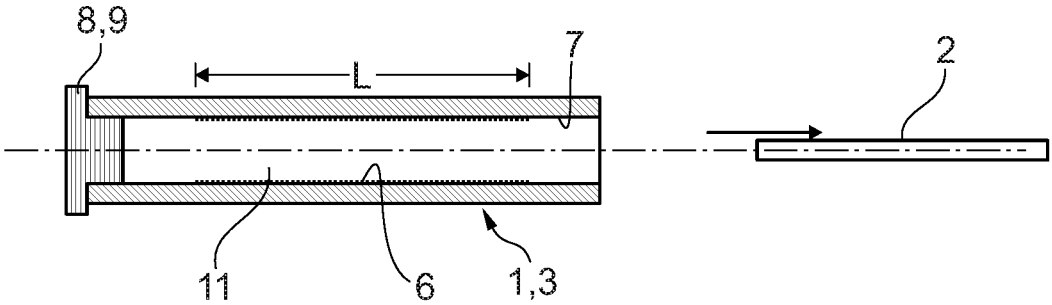

In a method step following thereon and shown according to FIG. 6, a corrosion protection medium 6 is applied at least in certain regions by means of the lance 2 on an inner lateral surface 7 of the hollow shaft 1 and in particular also on an end face of the cover 9 or of the plug 9, upon which in the method step according to FIG. 7 the lance 2 is moved out of the hollow shaft 1.

Here, the corrosion protection medium 6 can be output only over a length L and because of this not directly as far as to the right longitudinal end of the hollow shaft 1. This has the advantage that during a thermal joining of the cams or other components, no running out of the corrosion protection medium 6 from the hollow shaft 1 has to be feared. The introducing of the corrosion protection medium 6 only limited over a length L could also be employed for the case in which the plug 9 is positioned only thereafter. Here, the advantage would be offered that the hollow shaft 1 with corrosion protection medium 6 already introduced could be heated and the same need not have to be injected into a hot hollow shaft 1, so that an explosion risk can be reduced. The region outside the length L not wetted with corrosion protection medium 6 still offers sufficient adhesion surface for the torque transmission between inner lateral surface 7 and plug 9.

Obviously it is also clear that the hollow shaft 1 can be initially blown out as hollow shaft 1 that is open on both sides and subsequently closed on one side with a cover 8 or a plug 9. Following this, the lance 2 is moved into the hollow shaft once more and gas 4, in particular air, ejected in order to clean for example a plug joint and the inner lateral surface 7. During a following reverse movement of the lance 2, the corrosion protection medium 6 is then output. Alternatively, this can obviously also be output during a second entering of the lance 2.

Figure 8:
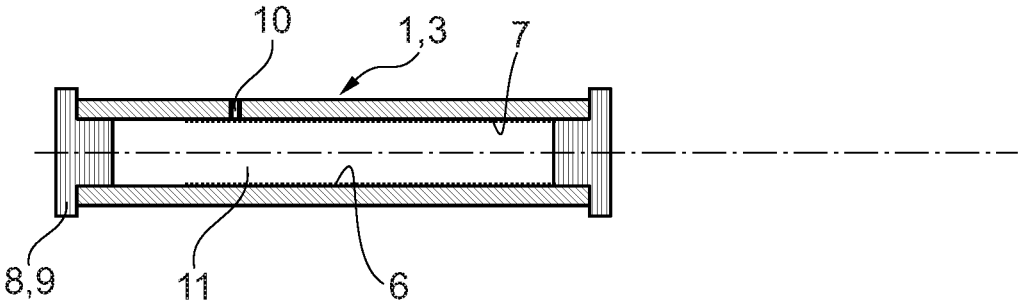

Finally, the hollow shaft 1, in the fourth method step, which is shown according to FIG. 8, is also closed off at the other longitudinal end by means of a plug 9 or a cover 8. To this end, the hollow shaft 1 can be heated again without it having to be feared that in the process the corrosion protection medium 6 leaks out of the same.

It is likewise clear that the lance 2 can be moved into the hollow shaft 1 initially without air output from the lance 2, after which a "blowing", i.e. an air output from the lance 2, subsequently takes place in order to blow traces of water out of a joint, in particular out of a plug joint. During the subsequent pulling out of the lance 2 from the hollow shaft 1, the corrosion protection medium 6 is then applied to the inner lateral surface 7 of the hollow shaft 1 at least in certain regions. Finally, a closing-off of the hollow shaft 1 can take place which was initially closed only on one side.

As corrosion protection medium 6, for example an oil, a grease, a wax, a dewatering medium with a corrosion protection medium and/or a drying agent can be used for example, wherein in particular oils, greases and wax seal the inner lateral surface 7 and by way of this keep any moisture or condensed remnants unintentionally entering the hollow shaft 1 away from the hollow shaft 1 even after the same has been closed, thereby protecting it from corrosion.

The gas 4 used for expelling the liquid 5 can be for example air or an inert gas, in particular argon, nitrogen, helium or similar. Such inert gases have the major advantage that these are inert and because of this do not or hardly react chemically.

With the method according to the invention any liquid 5 that may be present in the hollow shaft 1 can be almost completely expelled and at the same time the inner lateral surface 7 of the hollow shaft 1 sealed, as a result of which altogether a significantly improved corrosion protection can be achieved.

The invention claimed is:

1. A method for improving a corrosion protection of a hollow shaft, comprising:

introducing a lance into the hollow shaft;

cleaning and expelling a liquid from an inside of the hollow shaft via spraying a gas from the lance;

applying a corrosion protection medium onto an inner lateral surface of the hollow shaft at least in certain regions; and closing off the hollow shaft;

wherein closing off the hollow shaft includes connecting a plug to one longitudinal end of the hollow shaft prior to spraying the gas from the lance and prior to applying the corrosion protection medium; and wherein applying the corrosion protection medium to the inner lateral surface of the hollow shaft includes applying the corrosion protection medium to an axially facing surface of the plug.

2. A method for improving a corrosion protection of a hollow shaft, comprising:

introducing a lance into the hollow shaft;

cleaning and expelling a liquid from an inside of the hollow shaft via spraying a gas from the lance;

applying a corrosion protection medium onto an inner lateral surface of the hollow shaft at least in certain regions; and closing off at least one end of the hollow shaft to prevent the corrosion protection medium from leaking out of the hollow shaft wherein the at least one longitudinal end of the hollow shaft is closed off prior to spraying the gas from the lance and prior to applying the corrosion protection medium; introducing the lance into the hollow shaft includes moving the lance to a first position adjacent to the closed off longitudinal end of the hollow shaft; and spraying the gas from the lance includes pulling the lance out of the hollow shaft from the first position while spraying the gas from the lance.

3. The method according to claim 2, wherein:

closing off the at least one longitudinal end of the hollow shaft includes connecting a plug to one longitudinal end of the hollow shaft prior to spraying the gas from the lance and prior to applying the corrosion protection medium; and applying the corrosion protection medium to the inner lateral surface of the hollow shaft includes applying the corrosion protection medium to an axially facing surface of the plug.

4. A method for improving a corrosion protection of a hollow shaft, comprising:

introducing a lance into the hollow shaft;

cleaning and expelling a liquid from an inside of the hollow shaft via spraying a gas from the lance;

applying a corrosion protection medium onto an inner lateral surface of the hollow shaft at least in certain regions; and closing off the hollow shaft;

wherein spraying the gas from the lance includes passing the gas through at least one first nozzle of the lance;

wherein applying the corrosion protection medium to the inner lateral surface of the hollow shaft includes passing the corrosion protection medium through at least one second nozzle of the lance; and wherein the at least one second nozzle is disposed axially behind at least one first nozzle relative to a direction the lance is introduced into the hollow shaft.

5. The method according to claim 4, wherein applying the corrosion protection medium includes applying at least one of an oil, a grease, a wax, a dewatering medium with a corrosion protection medium, and a drying agent to the inner lateral surface of the hollow shaft.

6. The method according to claim 4, wherein spraying the gas from the lance includes spraying an inert gas.

7. The method according to claim 4, wherein spraying the gas from the lance includes spraying argon gas.

8. The method according to claim 4, wherein spraying the gas from the lance includes spraying nitrogen gas.

9. The method according to claim 4, further comprising, while spraying the gas from the lance, moving the lance coaxially to the hollow shaft at a distance of 0.5 mm to 3 mm from the inner lateral surface.

10. The method according to claim 4, further comprising:

performing a forward movement of the lance while spraying out the gas and expelling any of the liquid present in the hollow shaft; and performing a reverse movement of the lance while applying the corrosion protection medium to the inner lateral surface of the hollow shaft.

11. The method according to claim 4, further comprising performing a forward movement of the lance while (i) spraying out the gas and expelling any of the liquid present in the hollow shaft and (ii) behind the spraying relative to the entry direction, applying the corrosion protection medium to the inner lateral surface of the hollow shaft.

12. The method according to claim 4, further comprising introducing a plug into a longitudinal end of the hollow shaft (i) before spraying the gas from the lance and (ii) before applying the corrosion protection medium.

13. The method according to claim 4, further comprising, while spraying the gas from the lance, moving the lance coaxially to the hollow shaft at a distance of 1 mm to 2 mm from the inner lateral surface.

14. The method according to claim 4, further comprising:

performing a forward movement of the lance while (i) spraying out the gas and expelling any of the liquid present in the hollow shaft and (ii) applying the corrosion protection medium to the inner lateral surface of the hollow shaft;

performing a reverse movement of the lance after performing the forward movement of the lance; and applying another layer of the corrosion protection medium to the inner lateral surface of the hollow shaft while performing the reverse movement of the lance.

15. The method according to claim 4, further comprising performing a rotational movement of the lance while spraying the gas from the lance.

16. The method according to claim 4, further comprising providing the hollow shaft with at least one ventilation hole that fluidically connects the inside of the hollow shaft and an outside of the hollow shaft in a radial direction prior to spraying the gas from the lance and prior to applying the corrosion protection medium.

17. The method according to claim 4, wherein:

closing off the hollow shaft includes closing off one longitudinal end of the hollow shaft prior to spraying the gas from the lance and prior to applying the corrosion protection medium;

the lance is introduced into the hollow shaft in an entry direction; and spraying the gas from the lance includes spraying a gas jet in a direction opposite the entry direction while moving the lance in the entry direction.

18. The method according to claim 4, wherein:

closing off the hollow shaft includes closing off one longitudinal end of the hollow shaft prior to spraying the gas from the lance and prior to applying the corrosion protection medium;

introducing the lance into the hollow shaft includes moving the lance to a first position adjacent to the closed off longitudinal end of the hollow shaft; and spraying the gas from the lance includes pulling the lance out of the hollow shaft from the first position while spraying the gas from the lance.

19. The method according to claim 4, wherein:

closing off the hollow shaft includes connecting a plug to one longitudinal end of the hollow shaft prior to spraying the gas from the lance and prior to applying the corrosion protection medium; and applying the corrosion protection medium to the inner lateral surface of the hollow shaft includes applying the corrosion protection medium to an axially facing surface of the plug.

* * * * *